United States Patent [19]

Lee et al.

[11] Patent Number: 4,682,986

[45] Date of Patent: Jul. 28, 1987

[54] PROCESS FOR SEPARATING CATALYTIC COAL GASIFICATION CHARS

[75] Inventors: Wei-Kuo Lee, Bridgewater, N.J.; Hin-Wan Wong, Houston, Tex.

[73] Assignee: Exxon Research and Engineering, Florham Park, N.J.

[21] Appl. No.: 676,504

[22] Filed: Nov. 29, 1984

[51] Int. Cl.[4] ..... C10J 3/00; C10J 3/54

[52] U.S. Cl. ..... 48/210; 48/197 R

[58] Field of Search ..... 48/197 R, 202, 206, 48/210; 208/8 R, 11 R; 209/13, 38

[56] References Cited

U.S. PATENT DOCUMENTS

| | | | |
|---|---|---|---|
| 2,713,590 | 7/1955 | Palmer et al. | 260/449.6 |
| 3,261,463 | 7/1966 | Eveson et al. | 209/11 |
| 3,322,521 | 5/1967 | Cockerham | 48/63 |
| 3,700,422 | 10/1972 | Johnson et al. | 48/197 R |
| 3,957,459 | 4/1976 | Mitchell et al. | 48/197 R |
| 3,998,607 | 12/1976 | Wesselhoft et al. | 48/197 R |
| 4,118,204 | 9/1978 | Eakman et al. | 48/197 R |
| 4,193,771 | 3/1980 | Sharp et al. | 48/197 R |
| 4,276,062 | 6/1981 | Lyon et al. | 55/77 |
| 4,298,453 | 11/1981 | Schoennagel et al. | 208/10 |

*Primary Examiner*—Peter Kratz

*Attorney, Agent, or Firm*—E. Thomas Wheelock; Joseph J. Dvorak

[57] ABSTRACT

Carbon and catalyst containing chars obtained from a catalytic coal gasification or combustion operation may be separated into two layers of fractions by contacting them with an inert gas so as to fluidize them and thereby separately recover fractions of carbon-rich chars and fractions of carbon-poor chars, and collecting the separate fractions. The carbon-rich chars may then be recycled to the gasifier to be gasified, and the carbon-poor chars may be treated to recover the catalyst. Larger catalyst containing chars may be effectively separated in the presence of a host medium of a bed of solids fluidized by the inert gas. Smaller chars may be separated in the absence of such a host medium.

13 Claims, 8 Drawing Figures

PROCESS FOR SEPARATING CATALYTIC COAL GASIFICATION CHARS

FIELD OF THE INVENTION

This invention relates to a process for separating chars obtained from catalytic coal gasification operations or catalytic combustion processes into lower density carbon-rich chars and higher density carbon-lean chars. The process thereby allows recycle of a char having an enriched carbon content and the recovery of catalyst from the carbon-lean chars.

BACKGROUND OF THE INVENTION

Conventional non-catalytic processes for manufacturing synthetic fuels by gasifying coal or other carbonaceous solids, often called thermal coal gasification operations, generally require the reaction of carbon with steam at temperatures of about 1700° to 1800° F. to produce a gas containing hydrogen and carbon monoxide and some methane. This gas is then reacted with additional steam and subsequently treated to remove carbon dioxide and sulfur compounds. Finally, it is fed to a catalytic methanation unit for reaction of carbon monoxide and hydrogen to produce methane and water.

In catalytic coal gasification, the gasification step is carried out in the presence of a catalyst containing an alkali metal constituent such as potassium hydroxide. The alkali metal permits generation of the fuel gas at significantly lower temperatures. In such a process, the catalyst is typically dispersed onto the coal particles by wet impregnation. Operation of the process generally results in solids in the form of char particles which contain carbon and alkali metal catalyst residues. The chars include unconverted organic constituents of the coal (or other feed material) and inorganic constituents normally referred to as ash. The amount of ash present will depend on the composiion of the feed material, the gasification or other reaction conditions employed, and the residence time of the particles in the reaction zone. It is common practice to withdraw a portion of the char from the reaction zone to eliminate the ash and thereby keep the ash from building up within the gasifier or other reaction vessel. See, e.g., U.S. Pat. No. 4,193,771 which describes the technique in the context of catalyst recovery.

One method for separating solids generally is described, for example, in U.S. Pat. No. 4,276,062, which discloses use of a solid segregation in a fluidized state with no host medium so as to separate, by density, unwanted ash from desired unburned coal and limestone in a coal combuster.

Patents directed to enriching char in thermal gasification processes using a fluidized bed include U.S. Pat. Nos. 3,957,459 and 3,322,521. In the thermal processes, the density difference between the carbon-rich and carbon-poor particles is very small (i.e., less than a factor of two), making separation in a fluidized bed difficult or impractical. U.S. Pat. No. 2,713,590 is directed to a thermal gasification process wherein separation of light ashes from a coal gasifier is effected by high gas flowrate elutriation.

U.S. Pat. No. 4,298,453 discloses separation of chars from catalyst particles in a coal gasification reactor wherein the chars and catalyst particles are separate entities.

U.S. Pat. No. 3,700,422 discloses the separation of char from iron oxide particles in a steam-iron process without a host medium being employed for the separation.

In catalytic coal gasification a highly disproportionate amount of total unburned carbon is concentrated in a relatively small fraction of the particles withdrawn from the reactor. Overall carbon utilization could therefore be improved if the lower-density, carbon-rich fraction of chars could be recovered from the char product by separating them from the higher-density, carbon-depleted fraction of chars. The chars which are carbon-rich (enriched chars) could then be recycled for use in the gasification. Using a wet method, however, consumes water, requires drying of the char fractions recovered, and may result in water pollution. U.S. Pat. No. 3,998,607 discloses a method for catalyst recovery wherein the catalyst is leached from a mixture of solids (coal char and ash) having different densities to produce an enriched leaching agent with a density intermediate those of the solids the agent permits simultaneous separation of solids with densities respectively higher and lower than that of the leaching agent. Furthermore, the patent teaches that a preliminary density separation can be achieved using a gas to elutriate the down-flowing particles.

SUMMARY OF THE INVENTION

The present invention relates to a process for separating chars which may contain catalytic material obtained from a catalytic coal gasification operation or a catalytic coal combustion process. The separation is intended to result in a carbon-rich char fraction and a carbon-lean char fraction. The process includes the steps of: (a) fluidizing the catalyst chars with an inert gas while using a host material so that a fraction containing carbon-rich chars is separated from a fraction containing carbon-lean chars, and (b) collecting the separate fractions. Although an exhaustive discussion of the desired relationship between the relative sizes of the host material in the fluidized bed and the char materials to be separated is beyond the necessary scope of this disclosure, it may be generally said that the diameter of the host material should be smaller than that of the material to be separated. Generally, the ratio of the average diameter of a char particle to that of a host material particle may be larger than 3. Also, for this service it has been found that if the catalyst chars have an average diameter greater than about 150 microns, the fluidization should take place within a bed of host solids of an appropriately small size fluidized by the inert gas. If the chars have an average diameter between about 150 and 200 or 250 microns the separation probably will not be quite as efficient if a bed of host solids is present. However, this division area is not hard and fast and instead is defined largely by the particular operation into which this separation process is placed.

The catalyst-containing chars obtained from the catalytic coal gasification significantly differ in physical properties from the chars obtained from thermal gasification. In the latter, because the chars do not contain the alkali metal catalyst, the density difference between carbon-rich and carbon-poor particles is quite small (less than a factor of two). In contrast, the particles from catalytic coal gasification processes contain catalyst and the densities of the respective particles may differ by as much as a factor of four.

The process herein not only results in enhancement of carbon utilization in the process by enriching the chars for subsequent gasification and improving recovery levels of gas, but also results in lowering the cost of recovering the catalyst from the spent catalyst chars because the carbon-lean chars obtained by the process contain higher concentrations of catalyst. Thus, one fraction of chars is carbon-enriched for recycling to the gasifier and the other fraction of chars is catalyst enriched for catalyst recovery.

DESCRIPTION OF THE INVENTION

Figure 1A:
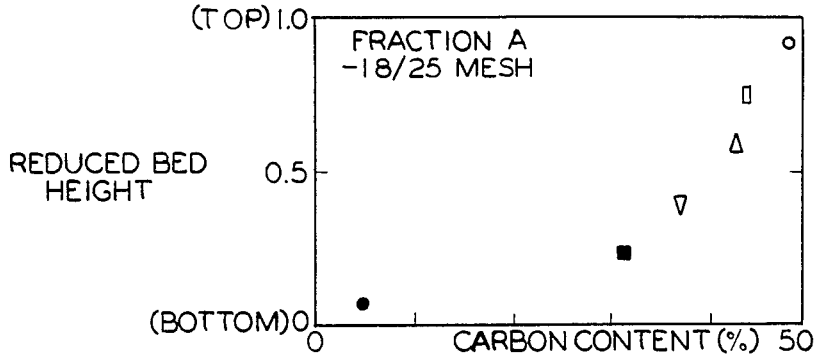
FIGS. 1A and 1B are graphs showing separation of carbon as a function of reduced bed depth in a fluidized bed using a host material.
Figure 1B:
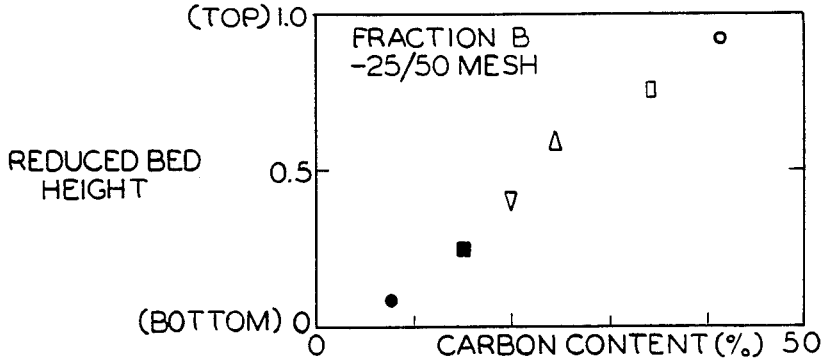
Figure 1C:
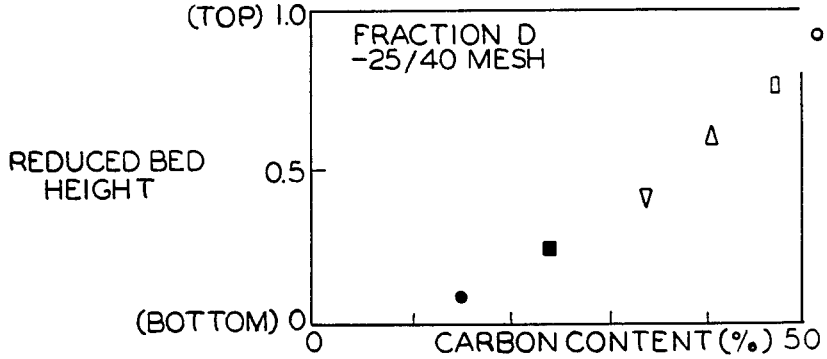
FIGS. 1C, 1D and 1E show graphs similar to those in FIGS. 1A and 1B but in a fluidized bed having no host material.
Figure 1D:
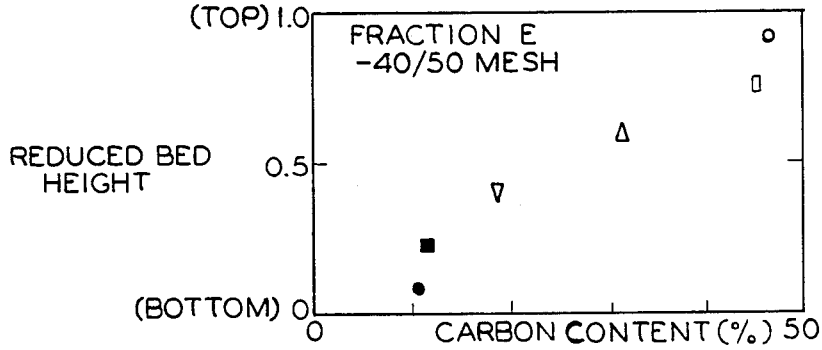
Figure 1E:
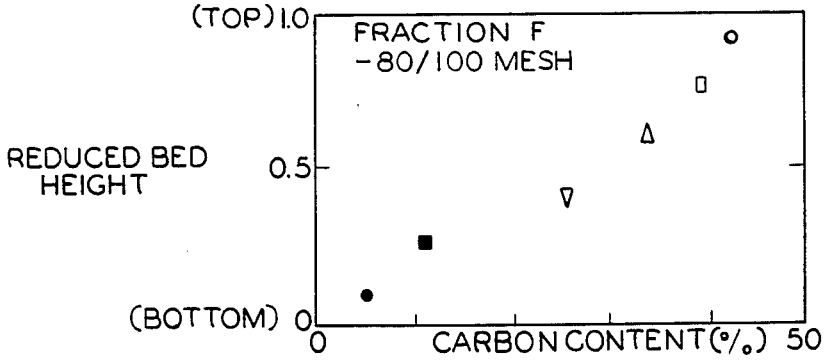

The catalytic coal gasification process from which the catalyst containing chars (which hereinafter will be referred to simply as "chars") are removed is made up of two major steps. The first step involves the preparation of a carbon-alkali metal catalyst or char. The char is produced by heating an intimate mixture of carbon and an alkali metal constituent at an elevated temperature, preferably a temperature of about 425° C. or higher. Carbonaceous solids which may be employed in preparing the catalyst-containing chars include coal (e.g., anthracite, bituminous, subbituminous, lignite, etc.), coal char, metallurgical coke, petroleum coke, charcoal, activated carbon or the like. The alkali metal constituents may include the alkali metals themselves or compounds containing the alkali metals such as alkali metal carbonates, bicarbonates, hydroxides and others. The preferred compounds are potassium salts, e.g., potassium carbonate or potassium hydroxide. The chars may contain from about 5 to about 50 weight percent alkali metal constituent.

Once the chars are prepared, they are dried and subjected to the second major step—the gasification step. This takes place in a gasification reactor at a temperature between about 540° C. and 815° C., preferably 700° C., and at a pressure between 300 psia and about 1500 psia, preferably 500 psia. Reaction rate and economic constraints define the lower and higher limits of these ranges. The reaction is carried out in the presence of steam and at least equilibrium quantities of carbon monoxide and hydrogen. The carbon monoxide-hydrogen stream may be recycled from the product stream once the desired methane gas and the diluents or impurities such as $CO_2$, $NH_3$ and $H_2S$ have been removed.

More details on overall catalytic gasification process are disclosed in U.S. Pat. No. 4,094,650 to Koh et al, issued June 13, 1978; the entirety of which is incorporated by reference.

The gasifier desirably employed in such a system is a refractory lined vessel containing the reactants in a fluidized bed. The bed is maintained in the fluidized state by the mixture of steam, carbon monoxide and hydrogen. The gasifier overhead contains the gaseous reaction products ($CH_4$, $CO_2$, CO, $H_2$, etc.) and some amount of the solid char and some ash-containing by products from the carbonaceous feed. It is these solids upon which the process of the invention disclosed herein operates.

It has been found that the gasifier effluent solids are of two distinct types, one of carbon-rich chars and one of carbon-lean solids, which have significantly different densities. This invention is drawn to a method for separating those solids using fluidized beds either with or without a host material.

In the separation process of this invention the chars which are obtained from the gasification reactor are fluidized with a gas such that the chars are separated into two fractions, one of carbon-rich chars and one of carbon-lean chars. The two fractions are then separately recovered. The carbon-lean fraction may be leached to recover the water soluble catalyst. The carbon-rich fraction (which may contain catalytic material) may be recycled to the gasifier.

Any gas may be used for the fluidization of the spent chars if the gas is inert, i.e., if it does not lead to combustion of the catalyst chars upon contact therewith. Suitable such gases include helium, argon, nitrogen, neon, carbon dioxide or mixtures of the above, and most preferably nitrogen or carbon dioxide. Carbon dioxide may be available as a byproduct of the gasification process.

The incipient fluidization velocity in a fluidization bed will depend on the size and density of the chars, the dimensions of the fluid bed, and the size and density of the host medium if such is employed. In any event, the localized gas velocity must be sufficient to lift the chars in the separating device, but not so great as to cause excessive bubbling or mixing of the chars. Generally, the velocity of the gas will range from about 0.2 to 20.0 cm per second, and the size of the chars to be separated will range from about 10 to 2000 microns or more, preferably 40 to 1000 microns.

The separation process herein may be conducted in the presence or absence of a host medium. The term "host medium" is meant to include solids which differ from the chars but are themselves fluidized by the inert gas. Whether to employ a host medium depends on many factors; however, for the purposes of this invention the principal factor is the size of the chars to be separated. For example, it is preferable to employ a host medium if the chars have an average diameter greater than about 150 microns since, in the absence of the host medium, higher gas velocities are necessary for fluidizing the larger particles. This may result in intense bubbling and poor separation. As the size of the chars is reduced, unwanted solid-solid intermixing between the chars and the host solids increases. Thus if the chars are no greater than about 300 microns in size, it is preferable not to use the host medium, but rather to use what will be referred to herein as a gas classification separation wherein the chars are separated due to segregation by direct fluidizing gas flow. The density of the host medium may be adjusted or selected so that it falls between the density of the light char product and the heavier char product. A particularly useful host medium comprises porous iron partricles. These are available (or producible) in a varieity of sizes and densities. The iron is a good choice since it may be separated from the product chars by a scavenger magnet. Other magnetizable solids are also acceptable, e.g., steels, series 400 stainless steels, etc.

The use of nonmagnetizable solids as the host medium is also contemplated. Indeed, a mixture of magnetizable and nonmagnetizable solids is often quite useful in adjusting the density of the overall host medium mix. Any number of inert materials such as silica, alumina, used cracking catalyst, etc. may be used in adjusting that density.

EXAMPLE 1

This example utilizes a batch fluidized bed to demonstrate that a fluidized bed containing a host medium is suitable for the separation of chars.

A catalytic coal gasification char sample was obtained from a gasification operation. The bulk of the sample (58%) was between 105 and 707 microns, and 37% of the sample was fines of −140 mesh (smaller than 105 microns). This sample was sieved by screening into three sizes, −18/25 (A), −25/50 (B) and −50/60 (C) mesh, respectively. The following general procedure was used to evaluate the density separations of each of these sieved fractions.

A vertical plastic vessel having an internal diameter of 5 cm and a height of about 30 to 50 cm was filled to a height of 6 to 10 cm with a host medium composed of a mixture of 81% of a cracking catalyst powder having a size less than 53 microns and 19% of porous iron powder having a size less than 105 microns. The vessel was adapted to allow the introduction of an inert gas through its bottom. This host mixture had a bulk density of about 1 gm. per cc. The minimum fluidization velocity $U_{MF}$ was about 1 cm per sec. Nitrogen gas was used to fluidize the host medium and was employed at a superficial gas velocity of about 1.6 cm per sec. so as to maintain a homogeneously blended mixture of the components.

After the gas was introduced to the host medium, the three sieved fractions of spent chars described above were separately introduced to the separation vessel. Each time, after either 2 or 3 minutes had elapsed, the gas flow was discontinued, the separated solid fractions in the vessel were vacuumed from the bed separately into six equilinear cuts and the chars were separated from the host medium by a screen for density analysis.

Particle densities of each of the six cuts obtained from each determination were estimated, using a voidage value of 0.43, from the apparent bulk density by dividing the mass of a given solid sample by its bulk volume in a graduated cylinder. Apparent bulk density is defined herein as mass of solids divided by loosely packed solid volume.

The conditions employed in each of the three separation tests for A-C mesh sizes are indicated in Table I.

TABLE I

| Conditions | Sieved Catalyst-Containing Chars A −18/25 mesh (707-1000 microns) | B −25/50 mesh (297-707 microns) | C −50/60 mesh (250-297 microns) |
|---|---|---|---|
| Solid Volume Concentration (%) | 20.6 | 20.6 | 15.46 |
| Gas Velocity (cm/sec.) | 1.48 | 1.48-1.77 | 1.48 |
| Bed density (g/cc) | 1.07 | 1.07 | 1.01 |
| Bed height (cm) | 6.3 | 10.4 | 6 |
| Test time (min.) | 3 | 3 | 2 |

Table II provides, in tabular form, the degree of separation of each of the sieved chars A-C into six fractions according to their apparent bulk and particle densities. At each reduced bed height range (each range representing one of the six cuts) the apparent bulk density and particle density for chars A-C are provided.

TABLE II

| Reduced Bed Height | Mesh Size A Bulk Density (g/cc) | Mesh Size A Particle Density (g/cc) | Mesh Size B Bulk Density (g/cc) | Mesh Size B Particle Density (g/cc) | Mesh Size C Bulk Density (g/cc) | Mesh Size C Particle Density (g/cc) |
|---|---|---|---|---|---|---|
| 0-0.167 | 1.095 | 1.990 | 0.910 | 1.650 | 1.265 | 2.220 |
| 0.167-0.333 | 0.790 | 1.435 | 0.780 | 1.420 | 0.725 | 1.275 |
| 0.333-0.500 | 0.640 | 1.165 | 0.885 | 1.620 | 0.650 | 1.140 |
| 0.500-0.667 | 0.585 | 1.065 | 0.920 | 1.670 | 0.670 | 1.175 |
| 0.667-0.833 | 0.460 | 0.845 | 0.570 | 1.040 | 0.640 | 1.125 |
| 0.833-1.000 | 0.330 | 0.620 | 0.435 | 0.790 | 0.450 | 0.785 |

The results indicate that the chars were separated into lighter fractions on the top of the bed (high bed height) and increasingly heavier fractions in the lower part of the bed. It will be recognized that the larger the ratio between the particle densities among the six cuts, the better the separation. The best results occured with the largest size chars A (−18/25 mesh). It is believed that this result was due to the decreased bubbling occuring with increased particle size. It is noted, however, that a density separation of chars as small as 250 microns (fraction C) is nonetheless possible.

FIGS. 1-A and 1-B show the carbon content of the six cuts of Fraction A and Fraction B as a function of reduced bed height. The segregation of char solids into high carbon fractions at the top of the bed is clearly shown to be at the optimum in FIG. 1-A. The larger char particle sizes are more efficiently separated in a fluidized bed containing a host medium.

EXAMPLE 2

This example illustrates the use of the gas classification technique whereby no host medium is employed in the fluidization for separation of three different size ranges of catalyst chars.

The same vessel was employed as described in Example 1. The chars sample of Example 2 was sieved by screening into three fractions of −25/40 (D), −40/50 (E) and −80/100 (F and G) mesh, respectively. These chars were added in four separate experiments (D-G) directly to the vessel, which was empty, and a flow of nitrogen gas was introduced at a rate indicated in Table III so as to fluidize the solids and impart sufficient mobility for segregation. The gas velocity employed depended on the density and size of the chars to be separated, with heavier and larger chars requiring a higher gas velocity. The densest chars settled out at the bottom of the vessel after a period of time, and the remainder of the bed remained fluidized. In three of the four experiments the gas velocities were lowered gradually to maintain a gentle fluidized state throughout the separation. After the designated period of time of 3 to 160 minutes, the nitrogen flow was discontinued and the chars were vacuumed from the bed in six equilinear cuts and measured for density as described in Example 1.

Table III provides the conditions of separation which were employed in each of the four experiments.

TABLE III

| Conditions | Sieved-Containing Catalyst Chars D −25/40 (420–707 microns) | E −40/50 (297–420 microns) | F −80/100 (149–177 microns) | G −80/100 (149–177 microns) |
|---|---|---|---|---|
| Bed diameter (cm) | 5.08 | 5.08 | 5.08 | 5.08 |
| Bed height (cm) | 6.6 | 6.8 | 4.9–4.6 | 5.45–5.0 |
| Gas Velocity (cm/sec.) | 16.9–25.4 | 8.37 | 2.66–1.58 | 2.7–1.6 |
| Test time (min.) | 30 | 160 | 3 | 34 |

Table IV relates at each reduced bed height range the apparent bulk density and particle density of each of the six cuts for the char fractions D to G.

TABLE IV

| Reduced Bed Height | Mesh Size D Bulk Density (g/cc) | Mesh Size D Particle Density (g/cc) | Mesh Size E Bulk Density (g/cc) | Mesh Size E Particle Density (g/cc) | Mesh Size F Bulk Density (g/cc) | Mesh Size F Particle Density (g/cc) | Mesh Size G Bulk Density (g/cc) | Mesh Size G Particle Density (g/cc) |
|---|---|---|---|---|---|---|---|---|
| 0–0.167 | 0.835 | 1.520 | 0.840 | 1.530 | 0.785 | 1.435 | 1.080 | 1.970 |
| 0.167–0.333 | 0.665 | 1.220 | 0.820 | 1.480 | 0.550 | 1.000 | 0.770 | 1.490 |
| 0.333–0.500 | 0.555 | 1.000 | 0.665 | 1.200 | 0.475 | 0.860 | 0.645 | 1.165 |
| 0.500–0.667 | 0.440 | 0.800 | 0.525 | 0.955 | 0.405 | 0.735 | 0.575 | 1.050 |
| 0.667–0.833 | 0.355 | 0.640 | 0.375 | 0.680 | 0.360 | 0.655 | 0.460 | 0.730 |
| 0.833–1.000 | 0.245 | 0.450 | 0.320 | 0.580 | 0.275 | 0.510 | 0.320 | 0.585 |

FIGS. 1-C, 1-D, and 1-E show that, in similar fashion to the fluid beds having a host medium, the larger char particles appear to be more efficiently separated into high-carbon and low-carbon fractions than are the smaller chars. The differences in times in the different runs obscures the results but the conclusion is seen as sound. The separation process practiced with the host medium appears to be more efficient for the heavier particles than the same process without the host. However, for the medium particles (as shown approximately by comparison of FIGS. 1-B and 1-C, respectively Fractions B and D), the fluid bed without the host medium appears to be the better choice.

Figure 2:
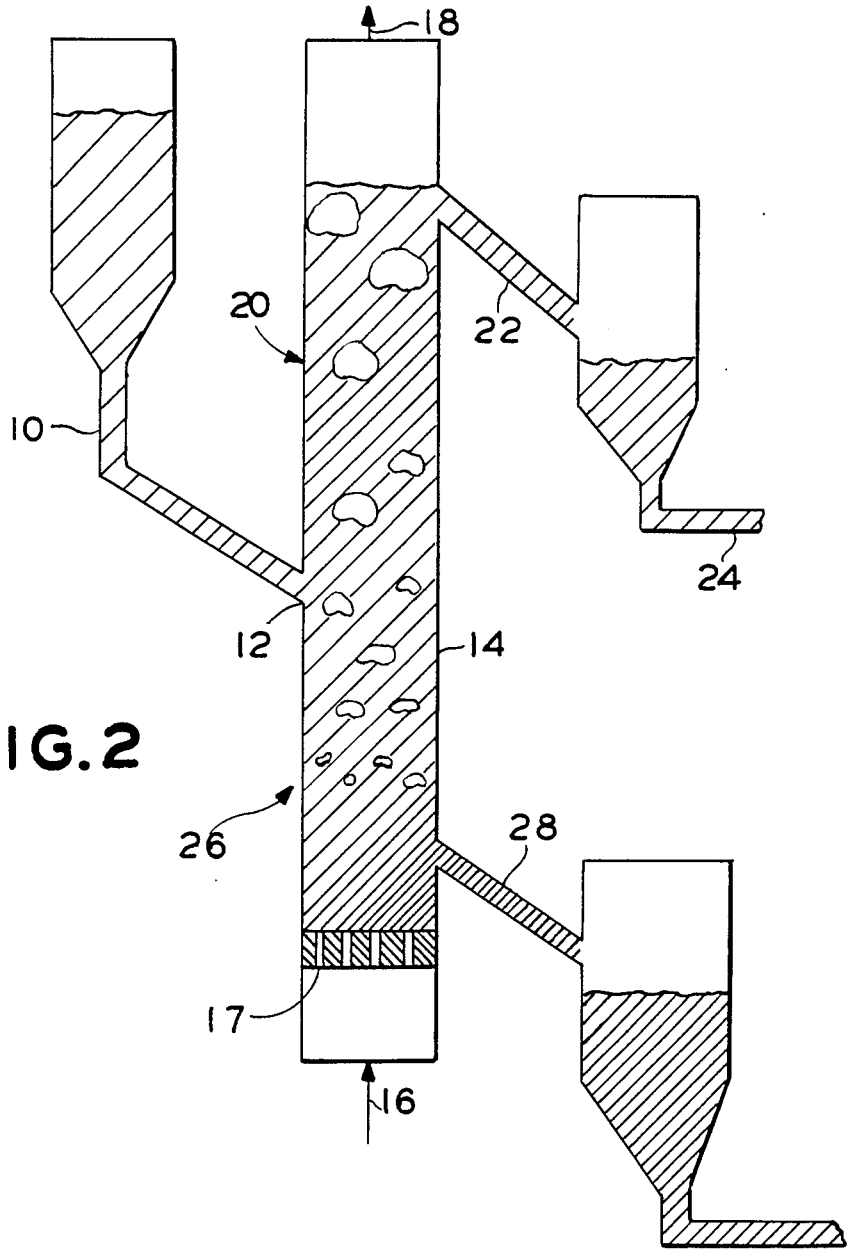
FIG. 2 illustrates an apparatus suitable for conducting a continuous separation using the instant invention.

A continuous gas classifier suitable for use with the invention is illustrated in FIG. 2. Spent chars from the gasifier are continuously fed via line 10 to the midpoint 12 of a vertical column 14 having a high length to diameter ratio. Of course, the vessel need not have an aspect ratio as high as this. Fluidizing gas 16 is introduced at the bottom of the column through distributor 17 and exits the column through the top 18. Upon proper choice of fluidizing velocity and proper adjustment at the bulk density of the fluidized bed, the high-carbon chars (being of lower density) will rise to the top of the bed. The low-carbon chars will sink to the bottom because of their respecting higher density. The carbon-rich chars in the low density region 20 of the column are continuously removed from the column via line 22 and may be recycled back to a gasifier through line 24. The carbon-lean chars in the high density region 26 of the column are continuously withdrawn via line 28 from the column for catalyst recovery. If a host medium is employed in bed, it should be separated from the char streams for further use.

In this gas classification system, if the chars are very small (i.e., 40 to 250 microns), a low gas velocity of about 1 to 2 cm per sec. is generally sufficient to effect the separation. If the densities of the various particles in a small char fraction are sufficiently widely spread, no host medium need be added and the particles will segregate by density. As char size varies, so obviously does the gas velocity required to fluidize those portions. If the bed tends to bubble at such high gas velocities, a host medium should be employed. It should be understood that the gas classification system may be used on char particles up to 1000 microns or more. However, for particles below 40 microns, the particles do not segregate well. Particles having diameters greater than 300 microns can be separated using gas classification but it is not generally economic to do so because of the high gas velocity required and the expensive gas producers required to make such a gas flow rate.

Figure 3:
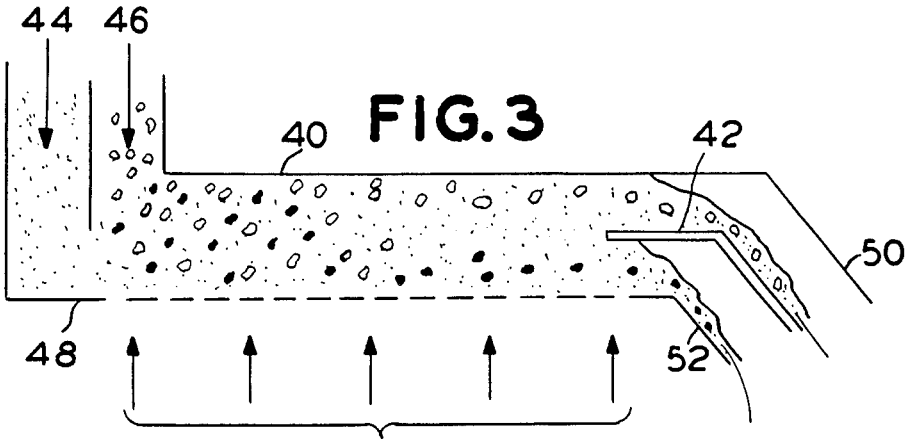
FIG. 3. illustrates a crossflow apparatus suitable for conducting a separation using the instant invention.

Another device which may be used with this invention is the cross flow bed shown in FIG. 3. A horizontal or cross-flow column 40 is employed as the separating device which is equipped with a divider 42 for separating the different fractions of chars at the right end thereof. The host medium may be introduced via line 44 to the column, and spent chars from the gasifier may be introduced via line 46 to the column. The fluidizing gas 47 is applied through a distributor 48 in the bottom of the column to lift the particles. The lighter chars and the host medium will exit above the divider 42 via line 50 for subsequent separation from the host material, recycle, and gasification. The more dense carbon-lean chars and host medium will exit below the divider via line 52 for subsequent separation from the host medium and catalyst recovery.

If a host medium is employed, the solids used for this purpose should be distinct in density and/or size from the chars to be separated. In this way they can be readily separated from the respective char fractions which are recovered. For use with a coal gasification char, the best results are obtained when the host solids have an average particle size of no more than about 105 microns. The inert gas flow rate is between about 0.5 to 20 cm per sec., preferably about 1–1.5 cm per sec. A gas velocity higher than this generally results in intense bubbling and undesired solids mixing. One preferred type of solids for use in the bed is porous iron particles, alone or in admixture with a fine powder such as a cracking catalyst powder such as used in refinery operations. Preferably, these powders have a size less than about 53 microns. One such mixture of iron particles and the cracking catalyst powders has a bulk density of about 1.36 gm/cc. The density of the mixture should generally be between 0.5 and 2.6 gm/cc.

Other operating conditions which may influence the effectiveness of the resulting separation include char concentration, the dimensions of the separating vessel, the temperature and pressure exerted on the chars during gasification, and the like.

In the process herein the separation may be improved by sieving the chars prior to fluidization thereof so that they will be of relatively uniform size. Such sieving eliminates size effects in the separation, so that only density will control in the separation of the chars. Sieving may be accomplished by the usual techniques known in the art for separating particles into various size ranges, the most common of which is to pass the spent chars through a screen of a certain mesh.

Figure 4:
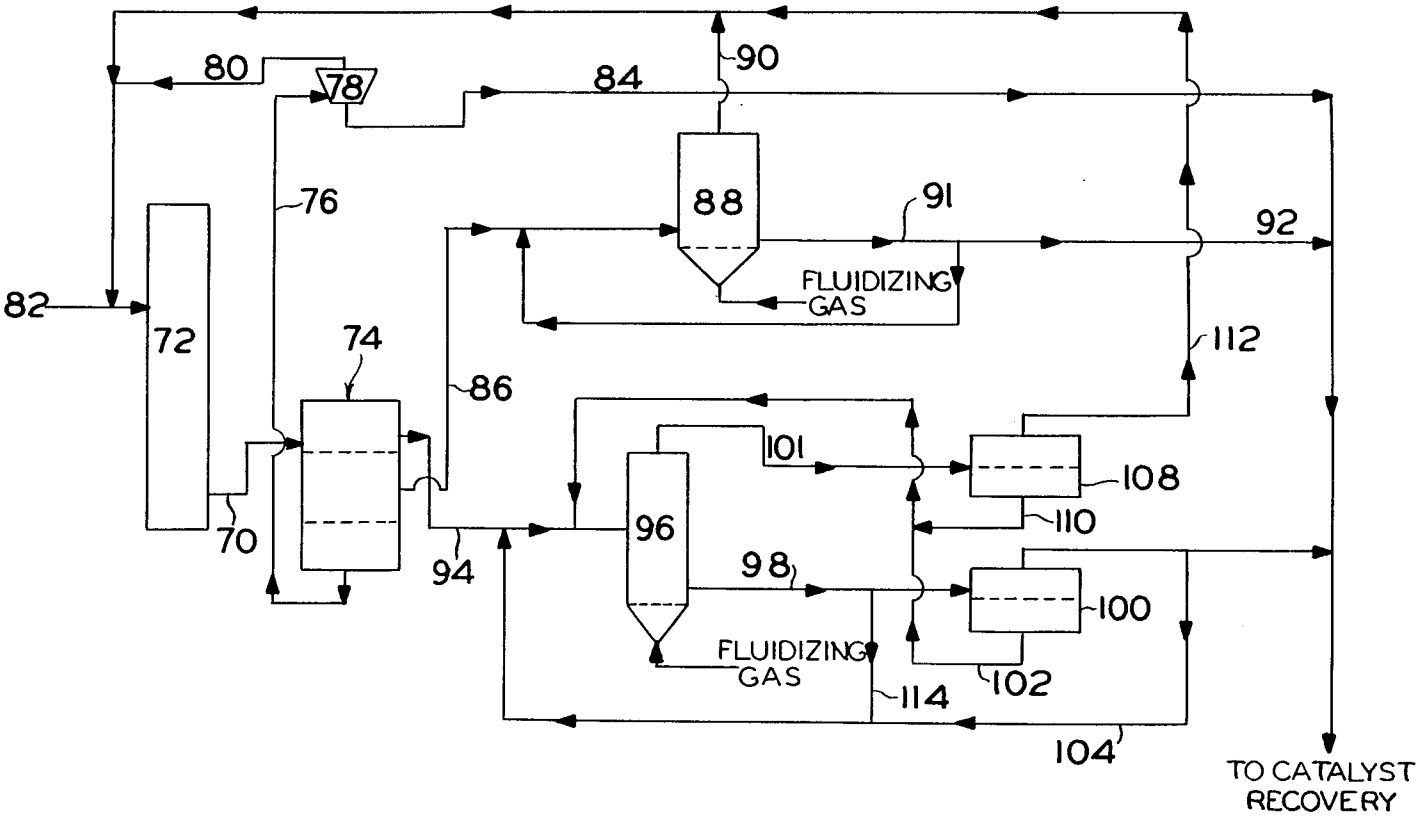
FIG. 4 represents a schematic process using a fluidized bed separation process described herein.

FIG. 4 shows a schematic process outline using the process of the invention disclosed herein.

A sidestream 70 of solids comprising mixtures of reacted and unreacted carbonaceous materials and catalyst is removed from gasification reactor 72. Since gasifier 72 is fluidized, it behaves as a well-mixed bed. The degree of particle mixing is quite high and the sidestream contains particles having a wide range of carbon contents and conversions. The sidestream 70 may be subjected to a two-stage sieving device 74. The smallest fraction (preferably passing through a 270 mesh sieve (53 μm), although −200 mesh (<74 μm) sieves are acceptable) exits the sieve 74 via line 76 and is subjected to a cyclone 78. The light ends, containing a high percentage of unreacted carbon, is recycled back via line 80 for mixing with the fresh feed 82 to gasifier 72. The heavier fraction from cyclone 78 is sent to a catalyst recovery operation via line 84.

The middle fraction (preferably having solids in the 25 to 230 mesh range (63–707 μm) although any combination of solids passing 18 mesh to 325 (44–1000 μm) mesh are acceptable) from sieve 74 is sent via line 86 to gas classifier 88. Classifier 88 is a fluidized bed using an inert gas but no host material. The light ends, containing the bulk of the unreacted carbon, are recycled via line 90 to be mixed with the fresh feed 82 to gasifier 72. The heavier fraction is withdrawn from gas classifier 88 via line 91 and, if desired or necessary to maintain an amount of solids sufficient for efficient operation, a portion recycled to the gas classifier 88. The remainder of the heavier fraction is sent to a catalyst recovery step via line 92.

The fraction leaving sieve device 74 having the largest average diameter is taken via line 94 to fluidized bed separator 96. This fraction, as discussed above, is preferably larger than 60 mesh (250 μm) although larger than 80 mesh (177 μm) is also acceptable. The efficient operation of gasifier 72 will inherently limit the upper size of this char fraction. Fluidized bed separator 96 is operated using an inert fluidized gas and an inert host material. The host material is chosen to provide a bed density, when fluidized, between the two extremes of the density of the feed char fraction. One very desirable host material is made up of an admixture of a powder-like material such as fluid bed catalytic cracking catalyst powder and less than about 105 μm porous iron particles having a bulk density of about 1.4 gm./cc. In such a case, a low superficial gas velocity, e.g., 1–2 cm/sec., may be used. The lighter or less dense char particles will "float" in the fluid bed of vessel 96 and the more dense char particles will "sink". Continuous streams are removed from the fluid bed. The lower stream is separated in sieve 100 to reclaim host material for recycle to fluidized bed separator 96 via line 102. The separated char is either sent to catalyst recovery or recycled via line 104 to vessel 96. As above, recycle of solids to the fluid bed may be desirable to maintain stable operation of the bed.

Although this example shows but a single fraction of char solids being separated by a single train separation device, e.g., cyclone 78, classifier 88, fluid bed separator 96, it should be clear that each of such separation devices may be operated in parallel where good engineering suggests such a practice. For instance, if the amount of solids in a particular size range is so large that a single separator bed would be of a size that would be either uneconomic to build or unstable to operate, then the use of two or more parallel beds would be appropriate and included within this invention.

The solids in overhead stream 106 from vessel 96 are separated in sieve 108 to produce a host material stream 110 for recycle to vessel 96 and a char stream 112 for recycle to gasifier 72. Char stream 112 contains the majority of the unreacted carbon of this size range leaving gasifier 72 via line 70. The sum of the recycled char solids found in lines 80 (from cyclone 78), 90 (from gas classifier 88), and 112 (from fluidized bed separator 96) typically will comprise about 15 weight percent of the solids leaving the gasifier 72 through line 70. However, that fraction should contain 80% to 90% of the unreacted carbon. Additionally, the catalyst recovery processes (not discussed in any detail herein) need treat only 85 percent of the sidestream solids stream 70.

Clearly, sieve devices 100 and 108 may be replaced by magnetic separators if the host material is magnetic. Similarly, recycle for the purpose of enhancing bed separation may be had through line 114 in lieu of or in addition to recycle line 104.

In summary, the present invention is seen to provide an improved process for separating chars obtained from catalytic coal gasification or combustion wherein carbon-rich and carbon-lean fractions can be obtained and separately treated so as to maximize the degree of gasification or combustion and to maximize catalyst recovery from the chars.

We claim as our invention:

1. A catalytic coal gasification process including the separation of chars containing soluble catalysts produced by the catalytic coal gasification process comprising the steps of:

(a) separating the chars by size into three portions, a first char portion having the largest average diameter, a second char portion having the middle average diameter, and a third char portion having the smallest average diameter, (b) subjecting the third char portion to a separation to recover a carbon-rich lighter fraction which is recycled to the catalytic coal gasification process and a carbon-lean heavier fraction suitable for treatment in a soluble catalyst recovery process, (c) subjecting the second char portion to fluidization with an inert gas to recover a carbon-rich lighter fraction which is recycled to the catalytic coal gasification process and a carbon-lean heavier fraction suitable for treatment in a soluble catalyst recovery process, (d) subjecting the first char portion to fluidization in the presence of host solids with an inert gas to recover a carbon-rich lighter fraction containing host solids and a carbon-lean heavier fraction containing host solids, (e) separating the carbon-rich lighter fraction made from the first char to produce a carbon rich recycle char which is recycled to the catalytic coal gasification process and host solids, and (f) separating at least a portion of the carbon-lean heavier fraction made from the first char to produce solids suitable for treatment in a soluble catalyst recovery process and host solids.

2. The process of claim 1 wherein the chars are separated into three portions by at least two sieving stages.

3. The process of claim 2 wherein the first sieving stage separates said char solids on a first sieve having a size between 18 and 25 mesh.

4. The process of claim 3 wherein the first sieve is 18 mesh and the second sieve is 50 mesh.

5. The process of claim 1 wherein the third char portion is separated in a cyclone.

6. The process of claim 1 wherein at least a portion of the carbon-lean heavier fraction from second char portion is recycled to said fluidization step (C) to be fluidized with the second char portion.

7. The process of claim 1 wherein the host solids in the first char fluidization step comprise porous iron particles.

8. The process of claim 7 wherein said host solids additionally comprise a catalytic cracking catalyst powder.

9. The process of claim 7 wherein the host solids have an average diameter between about 70 $\mu$m and 100 $\mu$m.

10. The process of claim 1 wherein the fractions from the first char fluidization step are separated from the host solids by sieves.

11. The process of claim 7 wherein the fractions from the first char fluidization step are magnetically separated from the host solids.

12. The process of claim 1 wherein at least a portion of the carbon-lean heavier fractions from the first char is recycled after removal of the host solids to the fluidization step employing host solids.

13. The process of claim 1 wherein at least a portion of the carbon-lean heavier fraction containing host solids is recycled to the fluidization step employing host solids.

* * * * *